US005443165A

United States Patent [19]

Hasui

[11] Patent Number: 5,443,165

[45] Date of Patent: Aug. 22, 1995

[54] BOBBIN FEEDING SYSTEM OF AUTOMATIC WINDER

[75] Inventor: Keini Hasui, Ohtsu, Japan

[73] Assignee: Murata Kikai Kabushiki Kaisha, Kyoto, Japan

[21] Appl. No.: 905,289

[22] Filed: Jun. 26, 1992

[30] Foreign Application Priority Data

Jun. 29, 1991 [JP] Japan ..... 3-182869

[51] Int. Cl.[6] ..... B07C 5/07; B65H 73/00

[52] U.S. Cl. ..... 209/602; 209/927; 28/292; 28/297; 242/35.5 A

[58] Field of Search ..... 209/656, 700, 927, 587, 209/600, 601, 602; 28/292, 297, 298; 242/35.5 A, 35.6 E, 36; 198/465.1

[56] References Cited

U.S. PATENT DOCUMENTS 2,907,091 10/1959 Ferguson ..... 28/297
4,295,569 10/1981 Niederer ..... 209/927 X
4,545,551 10/1985 Uchida et al. ..... 28/297 X
4,694,949 9/1987 Nakagawa ..... 209/927 X
4,783,887 11/1988 Trias ..... 28/292
4,827,090 5/1989 Nuerk ..... 242/36 X
4,970,764 11/1990 Trias ..... 28/292
5,170,953 12/1992 Stahlecker ..... 242/35.5 A

*Primary Examiner*—William E. Terrell
*Assistant Examiner*—Tuan N. Nguyen
*Attorney, Agent, or Firm*—Spensley Horn Jubas & Lubitz

[57] ABSTRACT

The bobbin feeding system of the automatic winder comprises a bobbin feedback line from the automatic winder which is branched off into a residual-yarn bobbin conveyor line and an empty-bobbin conveyor line, each conveyor line being joined with each other and connected to the empty-bobbin discharge line, and a bobbin stripper for removing residual yarn from the bobbin which is mounted on the residual-yarn bobbin conveyor line, thereby enabling smooth conveyance of bobbins.

3 Claims, 2 Drawing Sheets

BOBBIN FEEDING SYSTEM OF AUTOMATIC WINDER

BACKGROUND OF THE INVENTION

1. Field of the Invention

The present invention relates to a bobbin feeding system of an automatic winder which has a bobbin stripper disposed for removal of residual yarn from a bobbin in a part where bobbin yarn is fed into the automatic winder.

2. Prior Art

In a bobbin feeding system for feeding bobbins directly to an automatic winder from a fine spinning frame by a conveyor, bobbins coming back from the automatic winder are roughly divided into bobbins on which a specific amount or more of yarn remains, bobbins on which less than a specific amount of yarn remains, and empty bobbins; the bobbins on which a specific amount or more of yarn remains are carried to a bobbin yarn end finding device, while the empty bobbins and the bobbins carrying less than a specific amount of yarn are selected and conveyed to an empty bobbin discharge line side.

The empty bobbin is conveyed directly to the empty bobbin discharge line, but the bobbin carrying a small amount of residual yarn thereon must be conveyed onto the empty bobbin discharge line after removal of the residual yarn. Therefore it is practiced to mount a bobbin stripper for removing the residual yarn from the bobbin on which a small amount of yarn remains, on the bobbin discharge line from the automatic winder, or on a confluent conveyor line where the bobbin return line for returning a bobbin from which the yarn end finding device has failed in finding the yarn end meets the bobbin discharge line from the automatic winder.

In the above-described conventional bobbin feeding system, the bobbin stripper is mounted on a conveyor line for conveying both empty bobbins and residual-yarn bobbins together; that is, this bobbin feeding system has such a disadvantage that empty bobbins and bobbins with much residual yarn flow on the conveyor line on which the bobbin stripper is mounted, and therefore, all of the following bobbins have to wait while even a small amount of yarn is being stripped from the residual-yarn bobbin, and even a bobbin which need not go through the bobbin stripper waits before the bobbin stripper, disturbing smooth conveyance and circulation of bobbins.

OBJECT AND SUMMARY OF THE INVENTION

It is therefore an object of the present invention to provide a bobbin feeding system of an automatic winder which allows smooth conveyance of the bobbins.

To obviate the above-described disadvantage of the conventional bobbin feeding system, the present invention provides the bobbin feeding system of the automatic winder, in which a bobbin feedback line from the automatic winder is branched off into a small amount of residual-yarn bobbin conveyor line and a bobbin conveyor line for an empty bobbin and a large amount of residual-yarn bobbin; thereafter all the conveyor lines meet, being connected to the empty bobbin discharge line; and furthermore a bobbin stripper is disposed on the small amount of residual-yarn bobbin conveyor line for the removal of yarn remaining on the bobbin, thereby enabling the smooth conveyance of bobbins in this bobbin feeding system of the automatic winder.

According to the present invention of the above constitution, empty bobbins returning on the bobbin feedback line from the automatic winder are carried on the bobbin conveyor line, for an empty bobbin and a large amount of residual-yarn bobbin and only small amount of residual-yarn bobbins will go into a bobbin stripper where remaining yarn will be stripped by means of the bobbin stripper. The empty bobbins will never be sent into the bobbin stripper, and accordingly there will not occur such a problem that the empty bobbins have to wait before the bobbin stripper. The bobbins after the removal of residual yarn will be transferred onto the empty bobbin discharge line together with other empty bobbins coming on the bobbin conveyor line.

DETAILED DESCRIPTION OF PREFERRED EMBODIMENT

Figure 1:
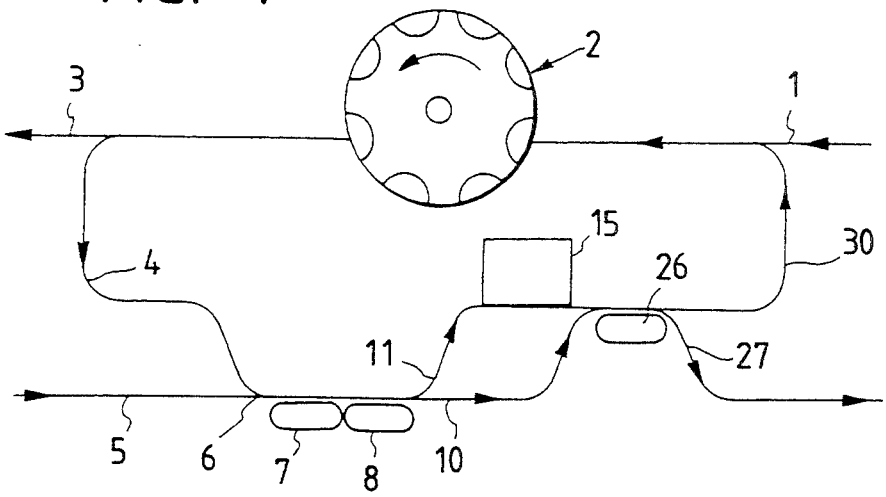
FIG. 1 is a system drawing showing an example of a bobbin feeding system according to the present invention.

Hereinafter an exemplary embodiment of a bobbin feeding system of an automatic winder according to the present invention will be explained with reference to the accompanying drawings. Yarn drafted on a fine spinning frame is wound on a bobbin into a form of a full bobbin, which then will be inserted upright on a tray and carried on a full-bobbin feed conveyor 1. In a bobbin yarn end finding device 2, a yarn end of a bobbin is found out and a bobbin with a yarn end hanging in the hollow upper end part is conveyed into the automatic winder by a conveyor 3 for feeding a full bobbin with its yarn end found. In the meantime, a bobbin with its yarn end not found in this yarn end finding device 2 is transferred to a return line 4.

An empty bobbin wound-up by a take-up unit of the automatic winder is conveyed on a bobbin feedback line 5. To this bobbin feedback line 5, residual-yarn bobbins having residual yarns besides fully wound-up empty bobbins are conveyed. The residual-yarn bobbins include those bobbins with large amount of residual yarn which will be returned again to the automatic winder for taking up the residual yarn, and those bobbins with small amount of residual yarn. The residual-yarn bobbins carrying large amount of residual yarn are sent together with full bobbins to the yarn end finding device, and after the yarn end is found, these bobbins are sent into the automatic winder, while the residual-yarn bobbins having small amount of residual yarn are conveyed as empty bobbins to the fine spinning frame after stripping off the residual yarn.

Figure 2A:
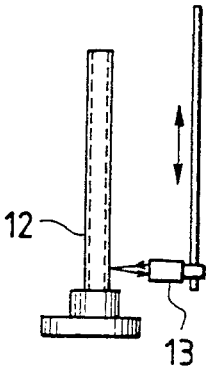
FIG. 2 is a schematic view of a detecting device used in the bobbin feeding system of the present invention.

Therefore, bobbins on the return line 4 from the yarn end finding device 2 and bobbins on the bobbin feedback line 5 are once brought onto a joined line 6. Along this joined line 6 are mounted a detecting device 7 for detecting whether or not the bobbins are empty and a residual-yarn amount detecting device 8. Empty bobbins and residual-yarn bobbins carrying large amount of residual yarn thus detected are sent onto the bobbin conveyor line 10. The residual-yarn bobbins with small amount of residual yarn are sent to a residual-yarn bobbin conveyor line 11. For example, as shown in FIG. 2*a*, photoelectric detecting device 13 consisting of a light emitting element and a light receiving element is brought close to a bobbin 12, and is moved in the direction of the axis of the bobbin 12 to detect whether or not yarn remains on the bobbin.

Figure 2B:
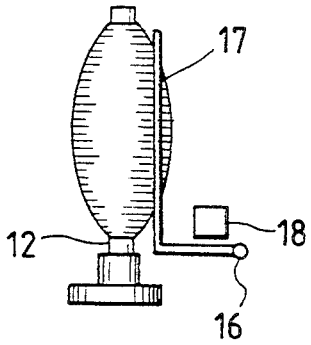

The amount of residual-yarn detecting device 8, as shown for example in FIG. 2*b*, is such a means that detects the deflection angle of a gauge 17 which rocks on the center of a rocking shaft 16 and is lightly pressed against the bobbin 12, by a sensor 18, thereby deciding bobbins on which much or little yarn remains, and returning onto the residual-yarn bobbin conveyor line 11 only those bobbins on which a small amount of residual yarn remains. On the residual-yarn bobbin conveyor line 11 is mounted a bobbin stripper 15, which will stop the bobbins having a small amount of residual yarn and strip them of the residual yarn.

Figure 3:
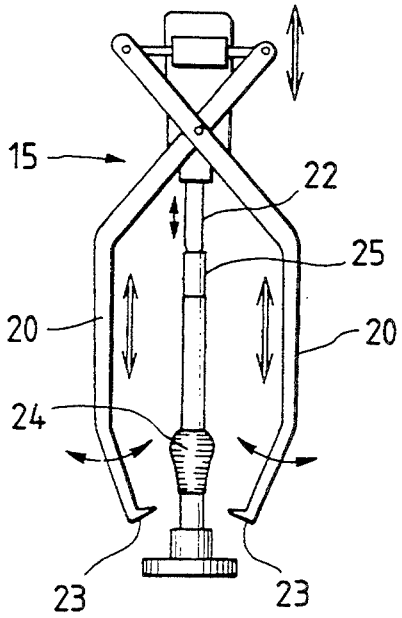
FIG. 3 is a side view of a bobbin stripper used in the bobbin feeding system of the present invention.

As a means for removing residual yarn from the bobbin, as shown for example in FIG. 3, the bobbin stripper 15 with stripping arms 20 left opened is moved downwardly toward the bobbin that has been stopped, to press a pressing member 22 at center against the center of the top end of the bobbin. Subsequently the stripping arms 20 are closed, then moved upwardly with the pressing member 22 held pressed against the center of the top end of the bobbin. When the arms 20 are moved upwardly, pawls 23 on the lower ends of the arms 20 catch a residual yarn 24, and pull off from the bobbin 25. The residual yarn will be sucked with suction.

On the residual-yarn bobbin conveyor line 11, the empty bobbin that has been stripped of residual yarn will be detected by an empty bobbin detecting device 26 and discharged out to the fine spinning frame through an empty bobbin discharge line 27. The bobbin having large amount of residual yarn is conveyed on the return line 30, joining with full bobbins from the full-bobbin feed conveyor and going again into the yarn end finding device 2, where the yarn end will be found.

The empty bobbins and the residual-yarn bobbins with large amount of residual yarn are sent to the bobbin conveyor line 10 and are checked by the empty bobbin detecting device 26 to see whether the bobbin is empty or not. Only an empty bobbin will be sent to the empty bobbin discharge line 27. At this time, a residual-yarn bobbin having a small amount of residual yarn, if being sent through the return line 30 to the yarn end finding device 2, will be returned from the return line 4 without the yarn end being found; and, as described above, the bobbin will enter the bobbin stripper 15, where a small amount of residual yarn will be fully removed.

Figure 4:
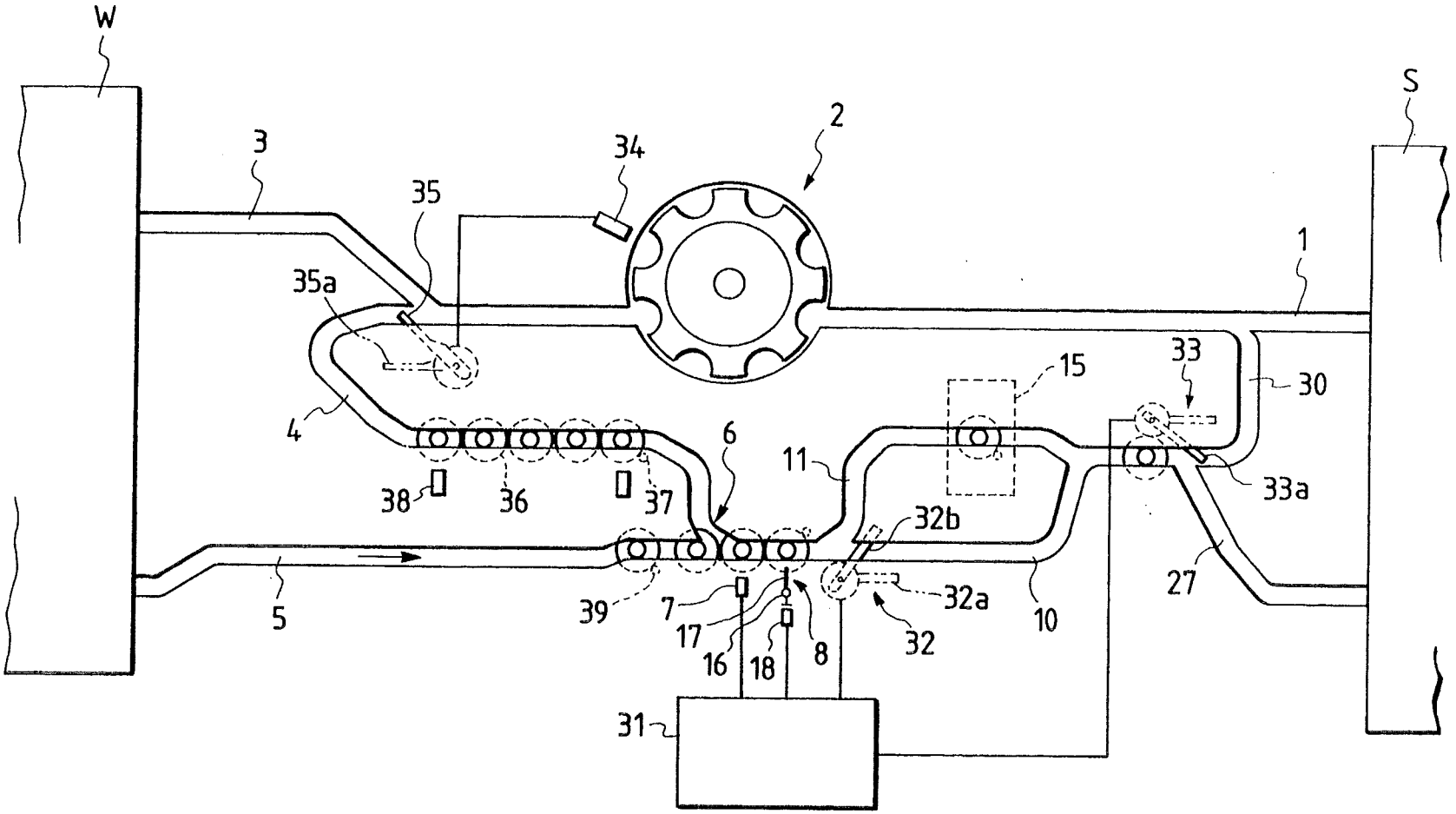
FIG. 4 is a system drawing showing another example of bobbin feeding system according to the present invention.

A detailed explanation of a further embodiment in FIG. 4 is followed.

Namely, each type of bobbin discharged from the winder W is sent along a return pass 5 and the empty bobbins are distinguished from the residual bobbins by a detector 7. Sensor 13 (FIG. 2*a*) moves up and down along the bobbin in all areas along the axis and depending on the difference between the amount of light reflected from a bobbin core and yarn, if the sensor signal goes on and off it is determined that there is residual yarn on the bobbin. But if the sensor goes off there will be no residual yarn, or in other words, it is determined that there is an empty bobbin. When it is determined that there is an empty bobbin, an operating signal from control device 31 is sent to the movable gate at the position indicated by the line 33*a* and there operates a rotary solenoid (or other type) of actuator. Further, without the gate 32 being operated, the gate 32 is kept in the waiting position 32*a*. As a result, the bobbins that have been determined to be empty by the detection device 7 are passed on to the detection device 8 and are returned to the spinning machine via conveyor belts 10 and 27.

Meanwhile, the bobbins that are determined to contain residual yarn by the detector 7, are determined to be either small residual yarn bobbins or large residual yarn bobbins by the residual yarn detection device 8. In other words, in the case of a large residual. yarn bobbin, the yarn layers displace a guage 17 which operates a sensor 18, and depending on the use of each sensor 18, the gate 33 maintains a waiting position (indicated by the dash-dot line) and gate 32 is maintained in the same way in a position indicated by the dotted line. Accordingly, the large residual yarn bobbins are once again returned to the yarn end finder from the bobbin conveyor path 10 via the conveyor path 30.

Next, when the detector 7 determines that there is residual yarn on the bobbins, the guage 17 is not displaced by the residual yarn detector 8, and the bobbins are thereby determined to be small residual yarn bobbins and the gate 32 moves to the position indicated by the line 32*b* and the gate 33 moves to position 33*a*. As such, the small residual yarn bobbins detected by the detector 8 are conveyed via a conveyor 11 and are stopped temporarily at the removal device 15 where the residual yarn is removed from according to the residual yarn removal step mentioned above. Next, the empty bobbins that have been brought down are transported to a conveyor belt 27 from. the gate 33*a* and then returned to the spinning machine S side. The bobbins that are missed by the residual yarn removal are arranged in the same position as the above mentioned detector 26 so that only the bobbins that have been distinguished from the empty bobbins as containing residual yarn can be transported to the conveyor path 30.

Further, at the yarn end finder 2, yarn end finding takes place and the bobbins are detected by the sensor 34 to have been either successfully or unsuccessfully dealt with at this step and any missed bobbins are thus detected. At this stage a gate 35 moves into the position indicated by the dash-dot line 35*a* and the bobbins missed by the yarn end finder processed via the conveyor path 4 and are stocked up at a stock line 36. In other words, the head bobbin comes into direct contact with the movable stopper 37 and stops while the following bobbins are stocked up to a predetermined number. If the sensor 38 continues beyond a pre-set period, the existence of bobbins is detected and the stock line 36 is determined to have become full. At this time the progress of the bobbins, above the return pass 5 at the point of convergence 6, is obstructed by the movable stopper 39 at a point upstream. In this state, the movable stopper 37 is released, bobbins in the stock line 36 are detected by the above mentioned detectors 7 and 8 in the above mentioned detection operation and the large residual yarn bobbins are once again returned via the conveyor paths 10 and 30 to the yarn end finder 2. In rare instances, empty or small residual yarn bobbins get mixed up in the stock line 36. However, even in this case these bobbins are determined to be either empty or small residual yarn bobbins by the detectors 7 and 8 and are distributed to the said conveyor paths as outlined above.

Since the bobbin feeding system is constituted and operates as stated above, no empty bobbin will be sent to the bobbin stripper, and while the residual yarn is being removed from the bobbin, no following empty bobbin will wait, thus enabling smooth conveyance of bobbin.

What is claimed is:

1. A bobbin feeding system for an automatic winder, comprising:

a bobbin feedback conveyor for conveying trays carrying bobbins from the automatic winder, a first conveyor for conveying trays carrying bobbins having a small amount of residual yarn, a second conveyor for conveying trays carrying empty bobbins and trays carrying bobbins having a large amount of residual yarn, the first and second conveyors branching from the bobbin feedback conveyor, an empty bobbin discharge conveyor to which at least the first conveyor is joined, and a bobbin stripper provided adjacent the first conveyor for removing residual yarn from bobbins on trays conveyed on the first conveyor, wherein the first and second conveyors define a branching location having an upstream side, and further comprising:

a first detecting device for detecting an empty bobbin, and a second detecting device for detecting an amount of residual yarn on a bobbin, the first and second detecting devices being located on the upstream side of the branching location.

2. The system of claim 1, wherein at least one of the bobbins defines an axis and wherein the first detecting device comprises a photoelectric device that is moveable in a direction substantially parallel to the axis of the bobbin and wherein the photoelectric device comprises a light emitting element and a light receiving element.

3. The system of claim 1, wherein the second detecting device comprises:

a gauge that is pressable against a bobbin and that is rockably supported on a rocking shaft to define a deflection angle, and a sensor for detecting the deflection angle of the gauge.

* * * * *